US005331976A

United States Patent [19]

St. Pierre

[11] Patent Number: 5,331,976

[45] Date of Patent: Jul. 26, 1994

[54] TRANSPORT JET ADAPTER

[75] Inventor: Richard E. St. Pierre, Charlotte, N.C.

[73] Assignee: Hoechst Celanese Corporation, Somerville, N.J.

[21] Appl. No.: 964,237

[22] Filed: Oct. 21, 1992

[51] Int. Cl.[5] ..... A24C 5/36; B31C 13/00; D01D 11/02

[52] U.S. Cl. ..... 131/96; 493/44; 493/48; 28/282

[58] Field of Search ..... 131/96; 493/44, 48; 28/117, 123, 116, 121, 282

[56] References Cited

U.S. PATENT DOCUMENTS

| | | | |
|---|---|---|---|
| 3,323,961 | 6/1987 | Gallagher | 156/180 |
| 4,390,031 | 6/1983 | Berger | 131/336 |
| 4,468,845 | 9/1984 | Harris | 493/44 |
| 4,594,162 | 6/1986 | Berger | 493/44 |
| 4,747,814 | 5/1988 | Berger | 493/44 |
| 5,106,357 | 4/1992 | Kampen | 493/44 |
| 5,203,757 | 4/1993 | Kampen | 493/44 |

*Primary Examiner*—Vincent Millin
*Assistant Examiner*—Steven B. Wong
*Attorney, Agent, or Firm*—R. H. Hammer, III

[57] ABSTRACT

Apparatus and method are provided for supplying cellulose acetate tow for the manufacture of cigarette filters from the transport jet of a tow opener to a cigarette filter rodmaking garniture. The apparatus is a frustoconical member having a multiplicity of apertures in the wall thereof and is attached directly to the transport jet. The apparatus has an internal diameter the same size as the exit opening of the transport jet. The opposite end of the adapter is inserted into the tow intake of the garniture. Transport gas that is introduced by the transport jet escapes through apertures in the adapter wall as the tow enters the garniture intake. A closely fitting rotatable sleeve having apertures in the wall thereof can be used to reduce the escape of transport gas through the adapter wall for optimizing performance of the adapter with tows of various processing characteristics. Tow yield is improved and pressure drop variability is reduced.

22 Claims, 6 Drawing Sheets

TRANSPORT JET ADAPTER

FIELD OF THE INVENTION

This invention relates to apparatus and methods for manufacturing filter tips for cigarettes from synthetic fibers. In particular, this invention relates to apparatus and methods for transferring an opened cigarette filter tow from a tow opening device to a rodmaker.

BACKGROUND OF THE INVENTION

Cigarette filter tow refers to a large strand of crimped, continuous, manufactured filaments, e.g. cellulose acetate filaments, that is collected in a loose, rope-like form and then compacted into bales for use by cigarette filter manufacturers. In processing the tow to form cigarette filters, the compacted and baled tow first is opened, or "bloomed" in a tow opening device. The tow is opened to increase its bulk. This bulking is accomplished by deregistering or misaligning the crimps or folds in the tow and is important to provide more fiber surface area for contact with cigarette smoke so that less fiber weight per filter tip can be used.

The opened tow is transferred to rodmaking machinery. The rodmaker compresses the tow into a continuous rod, wraps the rod in plug wrap paper to which an adhesive previously has been applied, and cuts the rod to form cigarette filter tips. These tips are suitable for use in the cigarette forming machinery.

Explemary methods and apparatus for blooming cigarette filter tow, transferring the bloomed tow to rodmaking machinery, and forming cigarette filter rods therefrom are discussed in U.S. Pat. Nos. 3,050,430; 3,016,945; 3,099,594; 3,173,188; and 4,522,616; and German Patent Application No. 0 269 915.

FIG. 1, labeled prior art, herein shows a typical, commercially available, rodmaking apparatus, the Hauni KDF-2 brand rodmaker. Rodmaking apparatus generally includes a section referred to as the "garniture," in which the filter rod is formed. The tow is received into the garniture from the tow opener through the relatively narrow opening, or intake, of a tapering body called the "garniture tongue." It is the function of the garniture tongue to compress the tow into a cylinder of the appropriate size for forming filter rods so that the tow can be wrapped by the plug wrap paper. The tow and plug wrap paper are conveyed through the tongue by an endless belt, the "garniture tape," from which the tow and plug wrap are released when the rod is formed, wrapped, and sealed.

The cigarette manufacturer typically desires a cigarette filter that, among other things, has a particular firmness, resistance to draw, and smoke filtration efficiency, all at the lowest possible cost and greatest efficiency of production. If the manufacturer consistently and at high processing speeds can reduce the weight of tow necessary to achieve a desirable firmness, smoke filtration efficiency, and resistance to draw, or pressure drop across the rod, then a cost savings typically is realized. Tow yield is maximized.

A "transport jet" and funnel, for example see FIG. 3 of U.S. Pat. No. 4,522,616, are used at higher processing speeds to increase efficiency and reduce costs of production. The jet and funnel introduce the opened tow from the tow opening apparatus into the relatively narrow opening of the garniture tongue intake. The transport jet is a pneumatic device that uses a compressed gas, typically air, in a venturi nozzle to assist in delivery of the opened tow into the garniture tongue. The funnel assists in precluding tow filaments from travelling outside the garniture tongue and in dissipating the compressed air exiting the jet, thereby to reduce disruption of the tow in the garniture by the transport gas. FIG. 2 herein shows a longitudinal section through such an arrangement, which is typical of the prior art.

Air holes for dissipating transport gas may be provided on the garniture tongue intake, the annular wall of the funnel to the garniture, or in the venturi nozzle of the transport jet on the tow opening device. Transport gas is also blown back in the direction of the transport jet, opposite the direction of travel of the tow, by the annular wall of the funnel.

European Patent Office Application No. 0 269 915 describes an apparatus that uses a transport jet and garniture funnel for forwarding a cigarette filter tow into the garniture tongue intake. In this device, the garniture intake is also supplied with compressed air through apertures in the intake wall. The compressed air enters the flow path of the tow in the direction of tow travel and at an angle less than 90° with respect to the axis of tow travel. A series of apertures is provided along the tongue so that the compressed air can be radially dissipated. Air is supplied to the garniture intake at a pressure of approximately 5 bar with air consumption of approximately 8 $m^3$ per hour.

The use of transport jets in combination with funnels typically has been acceptable. However, tow tends to accumulate in the funnel after exiting the transport jet, thereby impeding delivery of the tow to the garniture. It would be desirable to eliminate the funnel and to thereby substantially eliminate accumulation of tow in the region between the transport jet and garniture tongue so as to provide substantially unimpeded transport of opened tow from the tow opening apparatus to the garniture tongue.

SUMMARY OF THE INVENTION

An apparatus and method are provided whereby the opened tow can be conveyed at high processing speeds directly from the transport jet to the garniture tongue in the absence of the funnel typically used heretofore and without substantial accumulation of cigarette tow or blow back of transport gas in the region between the jet and the tongue. The funnel is eliminated by adapting the exit of the transport jet for unimpeded communication with the garniture tongue. A transport jet adapter, described in the embodiments summarized below, is used to interconnect the jet and garniture tongue intake.

Practice of the invention enables the production of cigarette filter rods having a more uniform distribution of crimped cellulose acetate fibers with a greater surface area transverse to the flow of cigarette smoke through the filter, thereby increasing pressure drop and smoke filtration efficiency for a given filter weight and desired firmness. Tow yield is improved without adding a compressed air requirement beyond that of the transport jet. For some tows, tow yield is increased beyond that obtainable at slower processing speeds without increasing pressure drop variability beyond acceptable limits.

In one embodiment, this invention comprises apparatus for interconnecting the exit end of a transport jet of a tow opening device with the intake of the garniture tongue of a rodmaker. One end of the apparatus has an opening for receiving tow from the transport jet exit that is coextensive with the opening of the exit of the transport jet. The other end of the apparatus supplies tow to the garniture intake. A passageway for the tow between the two ends of the apparatus has a multiplicity of apertures in the wall thereof so that transport gas from the jet is radially dissipated. Preferably, the tow passageway is conical and tapers from the opening at the first end to the opening at the second end.

More specifically, the end of the apparatus supplying tow to the garniture intake is sized to fit within the garniture tongue intake and may include a tow guide for guiding the tow into the tongue. This arrangement substantially precludes any filaments from travelling outside the garniture tongue. The apparatus may also include a flange-like collar having an integral sleeve for mounting the adapter on the transport jet so that the exit opening of the jet and the entrance opening of the apparatus may be contiguous.

In another embodiment, the apparatus may include a rotatable sleeve having a multiplicity of apertures in the wall thereof and being closely fitted to the wall of the tow passageway so that the size of the openings in the apertures in the wall of the passageway can be regulated. This embodiment provides for producing cigarette filter rods from different tows having different processing characteristics. The processing characteristics can impact transfer of the tow from the transport jet of the tow opener to the garniture of the rodmaker, and this impact can be substantially accounted for by regulating the dissipation of transport gas from the tow passageway of the apparatus.

The invention also comprises a method for improving the manufacture of cigarette filter rods wherein pressurized transport gas is removed from the filter tow transport path in the absence of an accumulation of tow and blow back of the transport gas. The transport path of the filter tow is continually constricted while radially removing pressurized transport gas to provide substantially unimpeded transfer of filter tow from jet to garniture.

BRIEF DESCRIPTION OF THE DRAWINGS

Specific embodiments of the invention are described with respect to the accompanying drawings in which.

DETAILED DESCRIPTION OF THE ILLUSTRATED EMBODIMENTS

Figure 1:
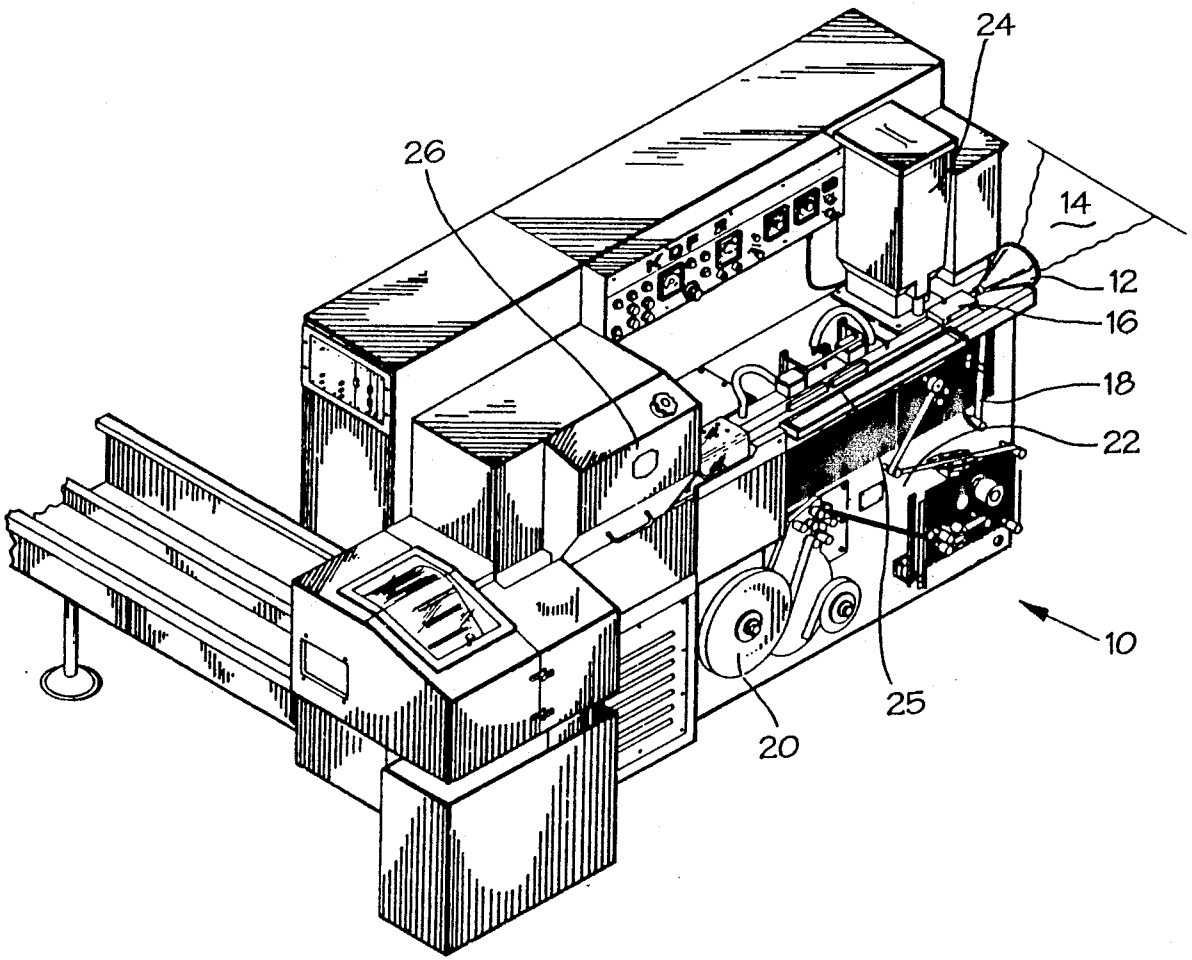
Fig. 1 Prior Art
FIG. 1 illustrates a perspective view of a typical, commercially available rodmaking apparatus.

FIG. 1 shows in perspective at 10 a Hauni KDF-2 brand rodmaker including a garniture funnel 12 such as is typical of the prior art manufacture of cigarette filter rods. The Hauni KDF-2 rodmaker is typical of the variety of commercially available rodmaking apparatus that is adaptable for practice of the apparatus and method of the invention claimed herein.

A fully opened cellulose acetate tow 14 is fed into the rodmaker 10 through garniture funnel 12. The apparatus and method of the invention claimed herein should be useful with crimped, continuous filaments of various types. However, cellulose acetate tow is preferred. Cellulose acetate tow is the major cigarette filter material currently in use in the world today. Cellulose acetate tow is a bundle of synthetic, continuous filaments that are non-toxic, tasteless, and odorless. Cigarette filters made from cellulose acetate tow typically are firm and white, with filtration characteristics that can be varied to appeal to a variety of tastes. A wide range of cellulose acetate tow products is available to the manufacturer of cigarette filter rods. Denier per filament (weight per unit of length), total denier, cross section of the fiber, crimp, and moisture levels can all be varied within limits during tow production to influence certain physical characteristics of filter rods, including firmness, weight, and pressure drop, or resistance to draw.

The garniture funnel 12 delivers the cellulose acetate tow 14 into a gradually tapering cylinder 16 (FIG. 2), called the garniture "tongue," which compresses the tow into a cylinder of the appropriate size so that it can be wrapped by plug wrap paper. A strip of plug wrap paper 18 supplied from a roll 20 is centered in the lower section of the garniture, which is shown at 22. The tow and plug wrap paper are conveyed through the garniture by an endless belt 32 (FIG. 2) called the garniture "tape." Adhesive from a melt reservoir 24 is applied to the plug wrap strip 18 for sealing the filter rod seam. Garniture folders 25 wrap the tow cylinder with the plug wrap and seal the cylinder to form a continuous wrapped rod of cellulose acetate tow. The garniture tape is released from the continuous wrapped rod after the rod is formed and sealed. Once formed and sealed, the continuous wrapped filter rod proceeds to a position 26 where cut-off knives (not shown) are used to cut rods in the conventional manner. Typically, the rods are four to six filter tips in length to accommodate cigarette making machinery.

Figure 2:
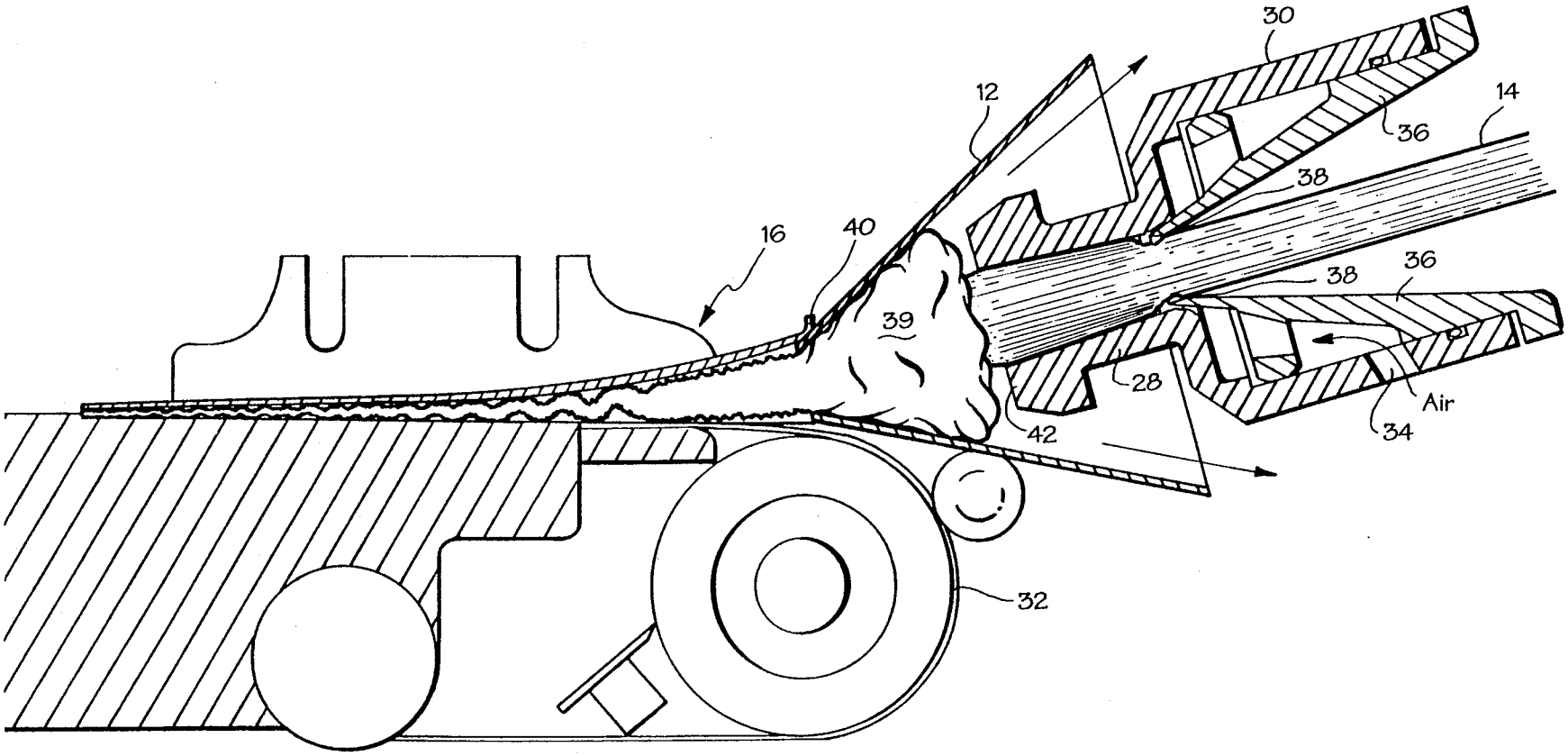
Fig. 2 Prior Art
FIG. 2 illustrates a longitudinal section through selected components of a prior art tow opening and rodmaking apparatus.

FIG. 2 (prior art) illustrates in longitudinal section the transport of a fully opened cellulose acetate tow 14 through the nozzle 28 of a Hauni jet 30 to the garniture tongue 16 of a rodmaker such as at 10 (FIG. 1). Nozzle 28 supplies tow 14 to the tongue 16 through the funnel 12. There are a variety of suitable jets with which the apparatus and method of the invention claimed herein may be used. Three types of transport jets typically are used for high speed production of filter rods. These include (1) the conical transport jet, (2) the pipe transport jet, and (3) the Hauni system. All of these types of transport jets are pneumatic devices that are based on the venturi principal. Compressed air is introduced into the transport jet and the tow and air are passed through an expanding diameter nozzle to reduce pressure and convey the tow into the garniture funnel.

Transport jets are used by the cigarette manufacturer to increase processing performance at high rates of production. The circumference, length, and minimum firmness of a cigarette filter are properties usually specified by the user, so the manufacturer of cigarette filters generally controls processing by manipulating the properties of rod weight and rod pressure drop to produce a filter that meets the customers' specifications and has the lowest possible target weight with an acceptable low pressure drop, typically not exceeding 100 mm $H_2O$ at a flow rate of 17.5 $cm^3$ per second. However, at higher processing speeds, the manufacturer has greater difficulty, without the use of a transport jet, in manipulating rod weight and pressure drop, and may experience a consequent loss in tow yield.

Tow yield may be defined as the relationship between the weight of tow in a cigarette filter rod and the pressure drop across that rod. Typically, a cost savings can be realized if tow yield can be increased by reducing the weight of tow needed to produce a given pressure drop while maintaining an acceptable rod firmness. Tow yield graphically is often illustrated by a tow characterization curve in which pressure drop is plotted against the weight of tow in a filter rod, from the minimum to the maximum combinations of weight and pressure drop. The tow characterization curve provides a method of determining whether a target pressure drop can be achieved with a particular tow, and, if so, at what rod weight. The position of a target filter rod weight in relation to the minimum and maximum weights for the tow item is called the "point in range," and gives an indication of the amount that processing conditions can be adjusted to meet the target filter rod weight while still maintaining an acceptable pressure drop.

As production rates are increased from about 200 to a more economic about 400 meters per minute, which is from about 2,000 to about 4,000 rods per minute, it becomes more difficult to obtain consistent pressure drop and weight values. Approximately 50 percent of the upper end of the rod characterization curve establishable at the lower processing speed is lost. This loss represents a reduction in the weight range within which an acceptable pressure drop can be obtained at more economic processing speeds. Reduction in weight range can make it difficult to consistently maintain filter rod weight and pressure drop specifications since the range of acceptable operation is narrowed. Transport jets as shown in FIG. 2 at 30 extend the weight range achievable at high processing speeds and recapture the upper portion of the characterization curve establishable at lower speeds, although variability in the pressure drop at higher speeds sometimes result.

Returning to FIG. 2, the tow 14 is picked up by the garniture belt 32 for transport through the garniture 22 of the rodmaker 10 (FIG. 1). Supply air enters the Hauni jet 30 through a port 34 and flows through a constricted space defined by a conical vane 36. Pressure is reduced on the down stream side of the opening 38 of the conical vane due to the venturi effect. Nozzle 28 is of expanding diameter in the flow direction. The effect of the jet 30 is to assist transport of the tow 14 at high speed to the garniture tongue 16. A garniture funnel 12 is used to assist intake of the transported tow into the garniture tongue 16.

As can be seen from FIG. 2, the prior art use of the garniture funnel 12 results in an accumulation or back up 39 of tow 14 in the funnel and blow back of transport air from the funnel, as shown by directional arrows. Tow accumulation impedes transport of the tow from the jet 30 to the garniture tongue 16 and increases the weight and therefore the cost of tow needed to obtain a specified pressure drop.

Weight is determined by the total denier of the tow and the rate at which the opened tow is fed into the rodmaker relative to the speed of the garniture tape. While not wishing to be bound by theory, it is believed that the accumulation of tow 39 causes at least a portion of the tow to be drawn into the tongue 16 by the garniture tape 32. Therefore, instead of being pushed into the garniture in a relatively relaxed state, the tow is placed under tension, which is thought to cause some undesirable straightening of the crimp and loss of tow yield. More tow is used as a consequence to obtain a desired pressure drop, possibly because less of the fiber in the filter tip is transverse to the flow path of the smoke particles. Uniform transfer of the tow to the garniture tongue 16 is impeded, the tow is disrupted, and the fibers in the filter tips may not be uniformly distributed as well.

Figure 3:
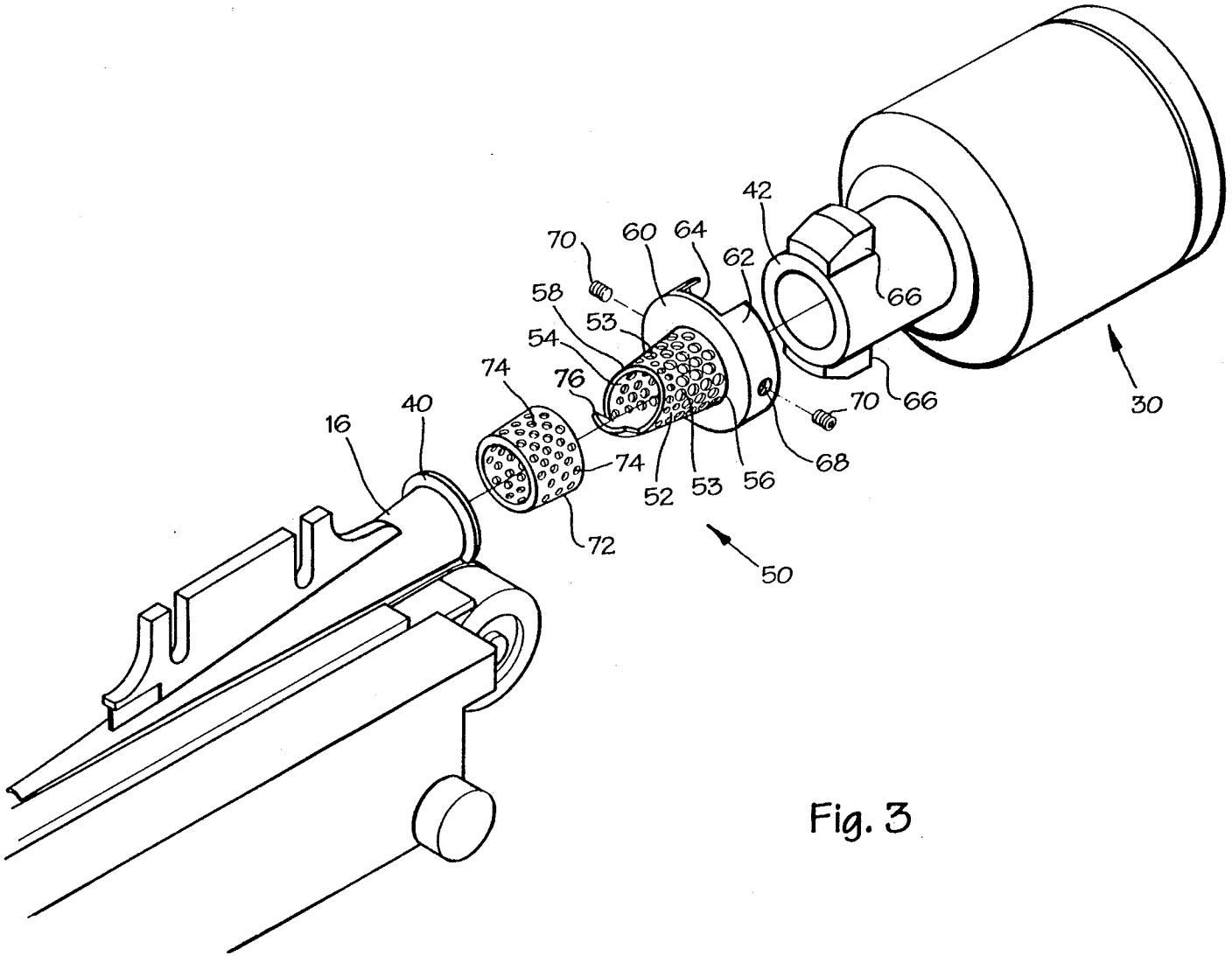
FIG. 3 illustrates an exploded perspective view of the apparatus of the invention claimed herein showing its relation to selected components of tow opening and rodmaking apparatus.
Figure 4:
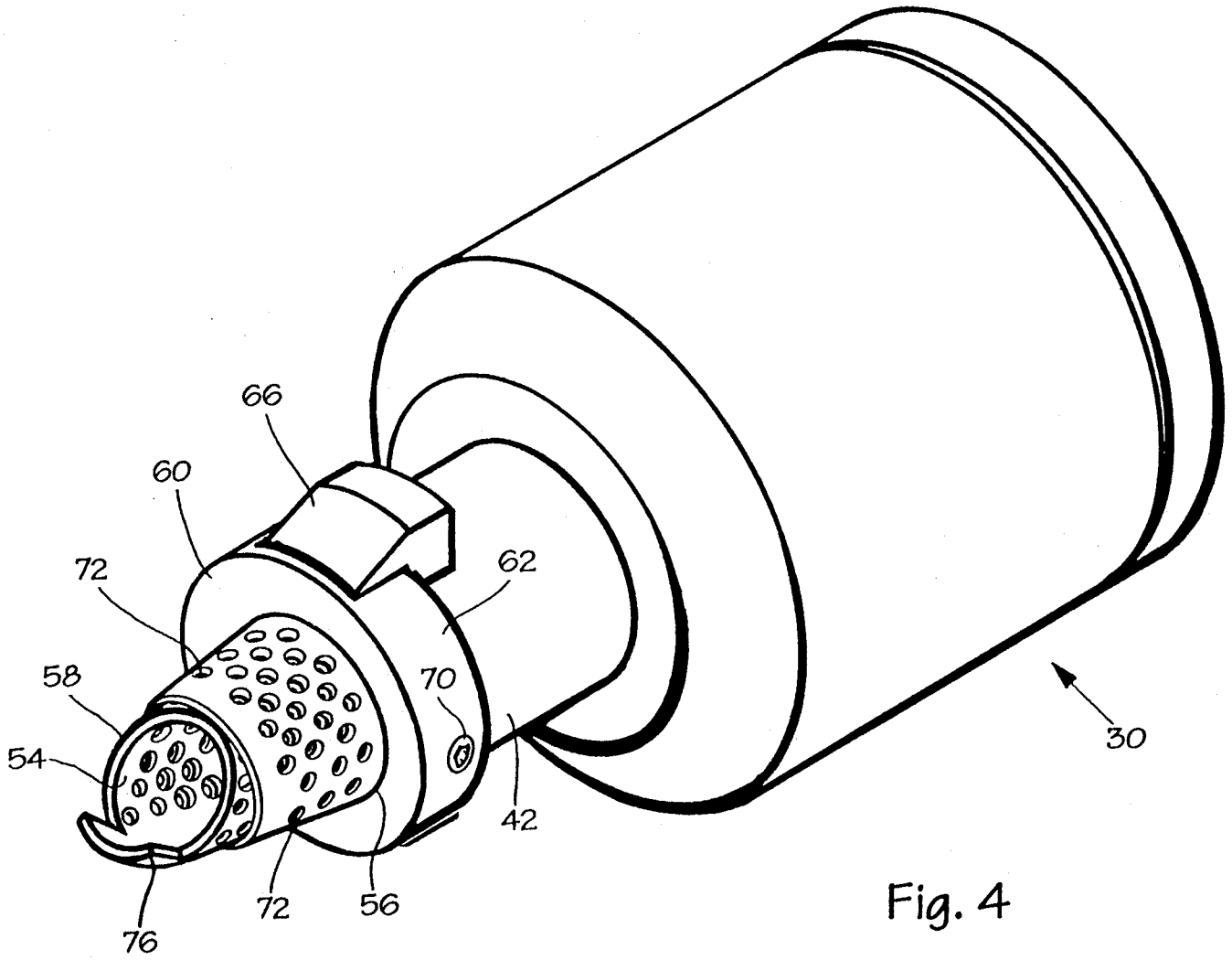
FIG. 4 illustrates the assembled apparatus of the invention claimed herein mounted on a component of tow opening apparatus.

FIG. 3 illustrates in exploded perspective the apparatus 50 of the invention claimed herein in relation to the transport jet 30 of a tow opening device and the garniture tongue 16 of a rodmaker. The fully assembled transport jet 30 and transport jet adapter 50 is illustrated in FIG. 4. The transport jet adapter 50 interconnects the exit end 42 of the transport jet 30 with the entrance end 40 of the garniture tongue 16 of the rodmaker. No garniture funnel 12, as is typical in the prior art, is used.

The transport jet adapter 50 includes frustoconical body 52 having a multiplicity of apertures 53 about its circumference. The apertures 53 provide openings through which transport gas can be dissipated so that the tow in the garniture tongue is not disrupted. The apertures 53 may range in diameter from 0.062 inches to 0.125 inches.

Body 52 has a tapering wall 54 defining an internal passageway for the passage of filter tow 14 from the transport jet 30 into the garniture tongue 16. The passageway has a first diameter portion 56 for communicating with the opening at the transport jet exit 42 that is substantially equal to the diameter of the exit 42 of the transport jet. A second, smaller diameter portion 58 at the entrance of the garniture tongue 16 is sized so as to fit into the garniture tongue. This arrangement substantially prevents fibers from traveling outside the garniture tongue from the transport jet adapter 52.

The adapter 52 also includes a flange-like collar 60 and an integral sleeve 62 adjacent to the large diameter portion 56 of the adapter. The sleeve 62 includes notched out portions 64 for engaging mating projections 66 on the Hauni jet 30. Threaded apertures 68 are provided on each side of the sleeve for screw attachment by screws 71 of the adapter to the exit 42 of the Hauni jet 30.

The apparatus 50 of the invention also includes a rotatable sleeve 72 that closely fits over the transport jet adapter 52 and has a multiplicity of apertures 74 in the wall thereof. Apertures 74 are about 0.094 inches in diameter. This sleeve 72 cooperates with the transport jet adapter 52 to adjust the size of the openings defined by the apertures 53 in the adapter wall. In this manner, the flow of transport gas through the adapter apertures 53 may be regulated to optimize performance of the adapter depending on the specific processing characteristics of the tow item. For example, the moisture content of a tow item can effect the transfer of the tow from the transport jet to the garniture tongue. It has been found in the practice of the invention claimed herein that tow yield may be further optimized by adjusting the size of the apertures 53 in the transport jet adapter.

Also shown in FIGS. 3 and 4, the transport jet adapter further comprises a tow guide 76 including a portion angled from the tow passageway adjacent to the intake 40 of the garniture tongue 16. The guide 76 guides the filter tow 14 into the garniture tongue 16 so as to substantially prevent tow fibers from traveling outside the garniture tongue on the lower side thereof. Guide 76 is formed by extending a portion of the annular wall 54 of the adapter body 52 beyond the opening at 58 and bending the guide into the flow path of the tow so as to guide the tow into the garniture tongue 16.

The entire adapter preferably is formed of stainless steel, although other suitable materials, including plastics, may also be used. However, the material should provide a smooth surfaced flow path for the tow without burrs upon which the tow might catch. Also, the apertures for the passage of transport gas outside of the adapter should be machined smooth so as not to catch filaments as the tow passes through the adapter to the garniture.

Figure 5:
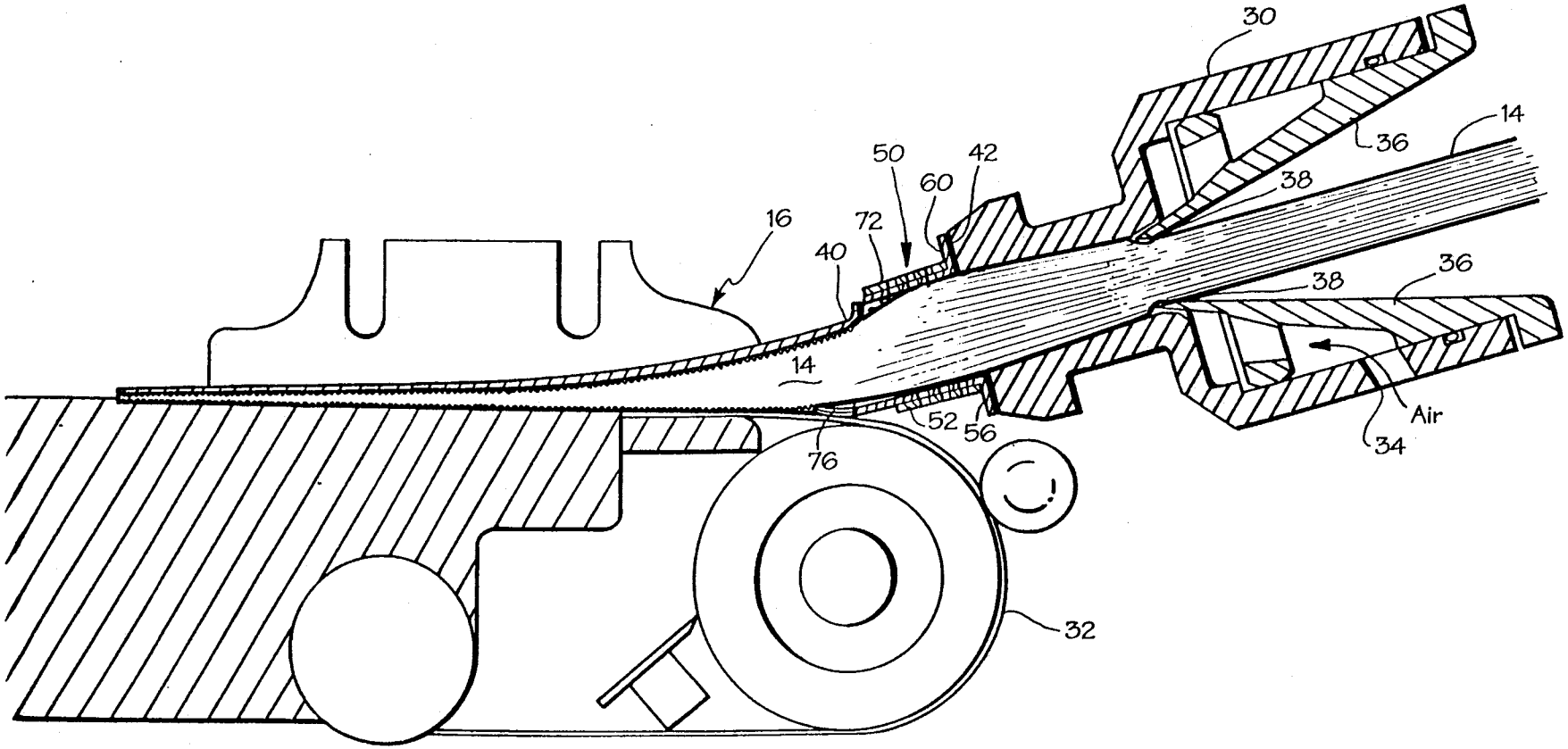
FIG. 5 illustrates a longitudinal section through the apparatus of the invention claimed herein installed in tow opening and rodmaking apparatus.

FIG. 5 illustrates in longitudinal section the transport of tow 14 through a transport jet 30 to the garniture tongue 16 through the transport jet adapter 50 of the invention claimed herein. Tow 14 is transported through the jet 30 in a manner described previously with respect to FIG. 2. However, instead of accumulating against the walls of the funnel 12 shown in FIG. 2, the filter tow travels unimpeded directly into the garniture tongue 16 of the rodmaker.

As can be seen in FIG. 4, unimpeded transfer of the tow 14 to the garniture tongue 16 is aided by the flow of the tow through the transport jet exit 49. into the adapter 50 without a change in diameter between the adapter 52 and the opening of the jet exit 42. The adapter 52 is mounted directly onto the tow exit 42 of the jet 30. The gradually tapering walls 54 of the transport jet adapter 52 provide a smooth transition to the interior of the garniture tongue 1 where the garniture tape 32 engages the tow for transport through the garniture. No region of accumulation of tow occurs between the transport jet and the garniture tongue. Therefore, the cigarette manufacturer can more readily control the rate at which the opened tow is fed into the rodmaker relative to the speed of the garniture tape to influence the weight of tow required to produce a given pressure drop and firmness.

The weight of tow needed in a filter rod to obtain a specific firmness and pressure drop will vary with the tow product purchased by the cigarette manufacturer. The weight of the tow in a filter rod directly influences firmness of the rod, cost of production of the rod, and the pressure drop obtained from that rod. However, each tow product has a characteristic range of achievable pressure drop and weight combinations (the tow characterization curve). Minimum and maximum possible weights correspond to minimum and maximum pressure drops and filtration efficiencies. Below the minimum rod weight, the plug wrap wrinkles and the fiber pulls back from the ends of the rod due to crimp retraction. Above the maximum rod weight, the pressure of the fiber mass within the rod can break the adhesive seam or else the tow band becomes slack at the opener and wraps around the delivery rolls to the garniture funnel. However, by practice of the invention claimed herein, the manufacturer of cigarettes can substantially increase control over the processing of various tows to produce cigarette filter rods at reduced cost.

Figure 6:
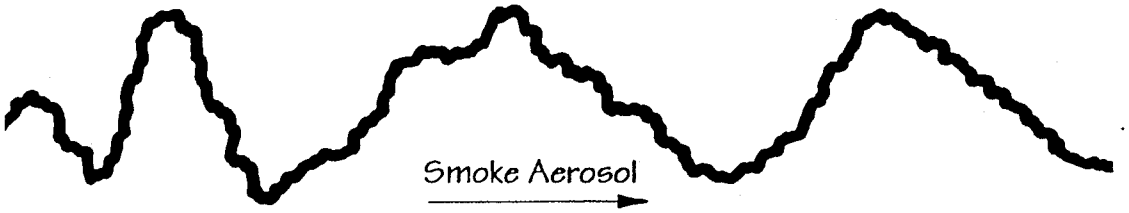
FIG. 6 represents a crimped cellulose acetate fiber typical of a prior art cigarette filter tip.
Figure 7:
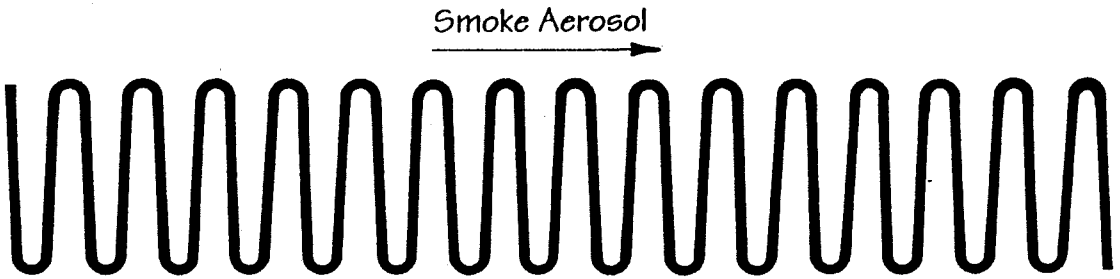
FIG. 7 represents a crimped cellulose acetate fiber typical of a cigarette filter tip made in accordance with the apparatus and method of the invention claimed herein.

FIGS. 6 and 7 compare cellulose acetate fibers typical of a conventional cigarette filter tip and a cigarette filter tip produced by the apparatus and method of the invention claimed herein, respectively. As can be seen in FIG. 6, a fiber from crimped, continuous filaments supplied to the garniture through a typical garniture funnel, where an accumulation of tow occurs between the transport jet and the garniture tongue, has a substantial component of its surface area parallel to the direction of flow of cigarette smoke through the filter tip. On the other hand, as shown in FIG. 7, a fiber typical of the cigarette filter tip produced in accordance with the method and apparatus of the invention claimed herein has a substantial component of its surface area transverse to the direction of flow of cigarette smoke through the filter. As is explained below, the greater a portion of a fiber that is perpendicular, or transverse, to the direction of smoke flow, the greater the smoke filtration efficiency of the filter for a given filter weight.

There are three primary mechanisms for the filtration of cigarette smoke particles: direct interception, inertial impaction, and diffusional deposition. If a smoke particle travelling in a smoke stream is within a suitable close distance to a filter fiber, then it collides directly with the fiber and is irreversibly removed from the smoke stream. This process is referred to as direct interception. Additional smoke particles may also be captured and irreversibly removed from the smoke stream. All smoke particles have mass (inertia) and experience Brownian motion. For example, cigarette smoke travels in streamlines around the individual fibers in a manner similar to the way in which air travels around an airplane wing or any other obstruction. When the momentum of a smoke particle is great enough, the particle can deviate from the original streamline in which it is traveling and follow its tendency to move in a straight line. If contact with the filter fiber results, then the particle is said to be removed from the smoke stream by inertial impaction. This mechanism is favored by high velocities and large particles.

Brownian motion is the random motion of microscopic particles suspended in liquids or gases resulting from the impact of molecules or fluids surrounding the particles. In the case of cigarette smoke, Brownian motion can cause smoke particles to cross streamlines. If the smoke particles move close enough to the filter fiber, they can be captured. This process is called diffusional deposition and is more probable for small, slower moving particles.

The changing nature of the smoke aerosol as a cigarette is smoked results in changes in the relative importance of each filtration mechanism during the course of cigarette consumption. Additionally, a cigarette filter system is more complex than can be explained by one smoke particle approaching a single acetate fiber since neighboring smoke particles and acetate fibers also affect the filtration process. However, inertial impaction, diffusional deposition, and direct interception are the major mechanisms of filtration of smoke particles from the smoke aerosol, and improved filtration can be obtained by a more uniform distribution of cellulose acetate fiber elements transverse to the direction of the flow of smoke particles in a cigarette filter rod or tip.

The invention claimed herein has been described with reference to the specific embodiments illustrated in the attached drawings, but it is not intended that the invention be limited to the scope of the specific illustrated embodiments. On the contrary, the skilled artisan will recognize that modifications may be made in the practice of the invention, and that the invention should be accorded the full scope of all equivalents as defined by the appended claims.

What is claimed is:

1. Apparatus for forming cigarette filter rods from cigarette filter tow comprising;

(a) means for opening a cigarette filter tow;

(b) a source of pressurized transport gas;

(c) a pneumatic transport jet having a first open end operatively connected to said tow opening means for receiving opened tow, a second open end, and a passageway therebetween connected to said source of transport gas;

(d) a cigarette filter rodmaker having a garniture for forming cigarette filter rods, a garniture tongue for compressing an opened cigarette filter tow, and a garniture tongue intake for receiving the filter tow; and (e) means for operatively interconnecting said second open end of said transport jet and said garniture tongue intake, said means having;

(i) a first open end substantially coextensive and communicating with said second open end of said transport jet;

(ii) a second open end communicating with said garniture tongue intake;

(iii) an annular wall defining a passageway between said first and second open ends and having a multiplicity of radial apertures therein for the passage of transport gas radially outwardly therethrough; and (iv) a flange-like collar including an integral fixed sleeve adjacent said first end of said means and integral with said annular wall, said collar and fixed sleeve mounting said means on the transport jet at the second end thereof.

2. Apparatus of claim 1 wherein said apparatus passageway is conical and tapers from the opening defined by said first end to the opening defined by said second end.

3. Apparatus of claim 1 wherein said annular wall adjacent said second end of said apparatus is sized so as to fit within said garniture tongue intake thereby to substantially prevent any portion of the cigarette filter tow from traveling outside the garniture tongue.

4. Apparatus of claim 1 wherein said annular wall includes a wall portion defining an angle in said apparatus passageway adjacent said second end of said apparatus that assists in guiding the filter tow into the garniture tongue intake.

5. Apparatus of claim 4 wherein said apertures in said annular wall of said passageway have a diameter of from about 0.062 inches to about 0.125 inches.

6. Apparatus for forming cigarette filter rods from cigarette filter tow comprising;

(a) means for opening a cigarette filter tow;

(b) a source of pressurized transport gas;

(c) a pneumatic transport jet having a first open end operatively connected to said tow opening means for receiving opened tow, a second open end, and a passageway therebetween connected to said source of transport gas;

(d) a cigarette filter rodmaker having a garniture for forming cigarette filter rods, a garniture tongue for compressing an opened cigarette filter tow, and a garniture tongue intake for receiving the filter tow; and (e) means for operatively interconnecting said second open end of said transport jet and said garniture tongue intake, said means having;

(i) a first open end substantially coextensive and communicating with said second open end of said transport jet;

(ii) a second open end communicating with said garniture tongue intake;

(iii) an annular wall defining a passageway between said first and second open ends and having a multiplicity of radial apertures therein for the passage of transport gas radially outwardly therethrough; and (iv) a rotatable sleeve closely fitted over and rotatable on said annular wall and having a multiplicity of apertures therein, said sleeve cooperating with said annular wall so as to reduce the size of openings defined by said apertures in said annular wall, thereby to regulate the flow of transport gas through said apertures in said annular wall.

7. Apparatus of claim 6 wherein said apparatus passageway is conical and tapers from the opening defined by said first end to the opening defined by said second end.

8. Apparatus of claim 6 wherein said annular wall adjacent said second end of said apparatus is sized so as to fit within said garniture tongue intake thereby to substantially prevent any portion of the cigarette filter tow from traveling outside the garniture tongue.

9. Apparatus of claim 6 wherein said annular wall includes a wall portion defining an angle in said apparatus passageway adjacent said second end of said apparatus that assists in guiding the filter tow into the garniture tongue intake.

10. Apparatus of claim 6 wherein said apertures in said annular wall of said passageway and in said rotatable sleeve have a diameter of from about 0.062 inches to about 0.125 inches.

11. Apparatus of claim 6 wherein said apparatus further comprises a flange-like collar including an integral fixed sleeve adjacent said first end of said means and integral with said annular wall, said collar and fixed sleeve mounting said means on the transport jet at the second end thereof.

12. In an apparatus for making cigarette filters from opened cigarette filter tow wherein the apparatus includes a cigarette filter rodmaker means and a means for opening the cigarette filter tow that includes a pneumatic transport jet for assisting in delivery of the opened tow from the tow opening means to the rodmaker means, and wherein the rodmaker means includes a garniture for forming cigarette filter rods, a garniture tongue for compressing an opened cigarette filter tow, and a garniture tongue intake for receiving the opened filter tow from the tow opening device, and wherein said transport jet includes a first open end for receiving the opened tow, a second open end, and a passageway therebetween for opened tow and for pressurized transport gas, the improvement comprising improved means for interconnecting the transport jet with the garniture tongue intake, said improved means comprising;

(i) a first open end substantially coextensive and communicating with said second open end of said transport jet;

(ii) a second open end communicating with said garniture tongue intake;

(iii) an annular wall defining a passageway between said first and second open ends and having a multiplicity of radial apertures therein for the passage of transport gas radially outwardly therethrough; and (iv) a flange-like collar including an integral fixed sleeve adjacent said first end of said means and integral with said annular wall, said collar and fixed sleeve mounting said means on the transport jet at the second end thereof.

13. Apparatus of claim 12 wherein said apparatus passageway is conical and tapers from the opening defined by said first end to the opening defined by said second end.

14. Apparatus of claim 12 wherein said annular wall adjacent said second end of said apparatus is sized so as to fit within said garniture tongue intake thereby to substantially prevent any portion of the cigarette filter tow from traveling outside the garniture tongue.

15. Apparatus of claim 12 wherein said annular wall includes a wall portion defining an angle in said apparatus passageway adjacent said second end of said apparatus that assists in guiding the filter tow into the garniture tongue intake.

16. Apparatus of claim 12 wherein said apertures in said annular wall of said passageway have a diameter of from about 0.062 inches to about 0.125 inches.

17. In an apparatus for making cigarette filters from opened cigarette filter tow wherein the apparatus includes a cigarette filter rodmaker means and a means for opening the cigarette filter tow that includes a pneumatic transport jet for assisting in delivery of the opened tow from the tow opening means to the rodmaker means, and wherein the rodmaker means includes a garniture for forming cigarette filter rods, a garniture tongue for compressing an opened cigarette filter tow, and a garniture tongue intake for receiving the opened filter tow from the tow opening device, and wherein said transport jet includes a first open end for receiving the opened tow, a second open end, and a passageway therebetween for opened tow and for pressurized transport gas, the improvement comprising improved means for interconnecting the transport jet with the garniture tongue intake, said improved means comprising;

(i) a first open end substantially coextensive and communicating with said second open end of said transport jet;

(ii) a second open end communicating with said garniture tongue intake;

(iii) an annular wall defining a passageway between said first and second open ends and having a multiplicity of radial apertures therein for the passage of transport gas radially outwardly therethrough; and (iv) a rotatable sleeve closely fitted over and rotatable on said annular wall and having a multiplicity of apertures therein, said sleeve cooperating with said annular wall so as to reduce the size of openings defined by said apertures in said annular wall, thereby to regulate the flow of transport gas through said apertures in said annular wall.

18. Apparatus of claim 17 wherein said apparatus passageway is conical and tapers from the opening defined by said first end to the opening defined by said second end.

19. Apparatus of claim 17 wherein said annular wall adjacent said second end of said apparatus is sized so as to fit within said garniture tongue intake thereby to substantially prevent any portion of the cigarette filter tow from traveling outside the garniture tongue.

20. Apparatus of claim 17 wherein said annular wall includes a wall portion defining an angle in said apparatus passageway adjacent said second end of said apparatus that assists in guiding the filter tow into the garniture tongue intake.

21. Apparatus of claim 17 wherein said apertures in said annular wall of said passageway and in said rotatable sleeve have a diameter of from about 0.062 inches to about 0.125 inches.

22. Apparatus of claim 17 wherein said apparatus further comprises a flange-like collar including an integral fixed sleeve adjacent said first end of said means and integral with said annular wall, said collar and fixed sleeve mounting said means on the transport jet at the second end thereof.

* * * * *